US005726632A

United States Patent [19]

Barnes et al.

[11] Patent Number: 5,726,632

[45] Date of Patent: Mar. 10, 1998

[54] FLAME IMAGING SYSTEM

[75] Inventors: Heidi L. Barnes, Covington, La.; Harvey S. Smith, Bay St. Louis, Miss.

[73] Assignee: The United States of America as represented by the Administrator of the National Aeronautics & Space Administration, Washington, D.C.

[21] Appl. No.: 622,178

[22] Filed: Mar. 13, 1996

[51] Int. Cl.[6] ..... G08B 17/12

[52] U.S. Cl. ..... 340/577; 340/578; 250/332; 250/339.15; 348/159

[58] Field of Search ..... 340/577, 578, 340/521; 250/339.15, 554, 332, 330; 348/154, 159, 61, 82, 83

[56] References Cited

U.S. PATENT DOCUMENTS

| | | | |
|---|---|---|---|
| 3,222,661 | 12/1965 | Vasel et al. | 340/578 |
| 3,553,665 | 1/1971 | Trumble | 340/578 |
| 3,609,364 | 9/1971 | Proffit | 340/578 |
| 3,633,192 | 1/1972 | Neiger | 340/578 |
| 3,659,043 | 4/1972 | Low et al. | 340/578 |
| 3,739,365 | 6/1973 | Muller | 340/578 |
| 3,748,471 | 7/1973 | Ross et al. | 250/333 |
| 3,943,499 | 3/1976 | Dunphy | 340/578 |
| 4,414,542 | 11/1983 | Farquhar et al. | 340/578 |
| 4,562,463 | 12/1985 | Lipton | 358/88 |
| 4,775,853 | 10/1988 | Borruat | 340/521 |
| 5,153,722 | 10/1992 | Goedeke et al. | 348/159 |
| 5,202,741 | 4/1993 | Snyder | 250/332 |
| 5,249,954 | 10/1993 | Allen et al. | 431/14 |
| 5,289,275 | 2/1994 | Ishii et al. | 348/159 |
| 5,339,070 | 8/1994 | Yalowitz et al. | 340/578 |

*Primary Examiner*—Brent A. Swarthout
*Assistant Examiner*—Van T. Trieu
*Attorney, Agent, or Firm*—Beth A. Vrioni; John G. Mannix

[57] ABSTRACT

A system for imaging a flame and the background scene. The flame imaging system consists of two charge-coupled-device (CCD) cameras. One camera uses a 800 nm long pass filter which during overcast conditions blocks sufficient background light so the hydrogen flame is brighter than the background light, and the second CCD camera uses a 1100 nm long pass filter, which blocks the solar background in full sunshine conditions such that the hydrogen flame is brighter than the solar background. Two electronic viewfinders convert the signal from the cameras into a visible image. The operator can select the appropriate filtered camera to use depending on the current light conditions. In addition, a narrow band pass filtered InGaAs sensor at 1360 nm triggers an audible alarm and a flashing LED if the sensor detects a flame, providing additional flame detection so the operator does not overlook a small flame.

19 Claims, 2 Drawing Sheets

FLAME IMAGING SYSTEM

ORIGIN OF THE INVENTION

The invention described herein was made in the performance of work under a National Aeronautics and Space Administration ("NASA") contract and is subject to the provisions of Section 305 of the National Aeronautics and Space Act of 1958, Public Law 85-568 (72 Stat. 435; 42 U.S.C. 2457).

BACKGROUND OF THE INVENTION

The present invention relates to a handheld fire imaging system. NASA operates facilities where hydrogen fires pose a threat to the safety of personnel and equipment. Hydrogen fires present a unique challenge since the hydrogen flame is invisible to the human eye during daylight conditions. Addressing these safety concerns, NASA's Stennis Space Center developed the flame imaging system to visually determine the existence, size and location of hydrogen fires.

Non-imaging fire detectors are available that can sense the presence of a hydrogen flame, but these detectors do not display the size and location of the fire. Commercial imaging devices are also available, but they produce a thermal image that often exaggerate the size of the flame and require a skilled operator to interpret. In addition, the thermal imagers are expensive and are not designed for portable operation in emergency situations or hazardous environments.

A low-cost and mobile method suggested in the 1991 National Fire Protection Association (NFPA) handbook for locating a hydrogen fire is by throwing dirt or sweeping a corn straw broom in the suspect area. These suggested methods are not only dangerous, especially during windy conditions, but also present accuracy concerns for detecting small flames.

Hydrogen flame emissions are not visible to the human eye because reflected solar radiation obscures the visible hydrogen flame emissions. However, a hydrogen flame can be detected in several infrared regions where the hydrogen flame emissions are greater than the solar background radiation. Alcohol fires, typical hydrocarbon fires, and hot embers also have emissions in the same infrared regions as hydrogen fires. The present invention filters sufficient background light to image hydrogen, hydrocarbon and alcohol fires, and hot embers.

SUMMARY OF THE INVENTION

The present invention is intended to fulfill the above identified need by providing a system to image invisible flames and hot embers.

The preferred embodiment of the invention includes two charge-coupled-device (CCD) cameras. One camera, the "cloudy camera," uses a 800 nanometers (nm) long pass filter which during overcast conditions blocks sufficient background light so the hydrogen flame is brighter than the background light. The second CCD camera, the "sunny camera," uses a 1100 nm long pass filter which blocks the solar background in full sunshine conditions such that the hydrogen flame is brighter than the solar background. Electronic viewfinders convert the signal from the camera into an image. A switch allows the operator to select the appropriate camera to use depending on the current light conditions. In the preferred embodiment of the invention, the imager includes an auxiliary flame detector which consists of a narrow band pass filtered Indium Gallium Arsenide (InGaAs) sensor at 1360 nm that triggers an alarm when a flame is detected. The InGaAs sensor may also be effectively filtered at 1480 nm.

An advantage of the present invention is that an operator can visually determine the location, size, and growth rate of a flame during daylight conditions without endangering the operator's safety. This handheld hydrogen fire imager is portable and may be used in emergency situations or hazardous environments. The imager employs two cameras with different filters, allowing imaging of hydrogen flames in widely varying light conditions. This invention provides an image of a hydrogen flame and the background scene such that the flame location, size, and growth rate can be determined in relation to the background. In addition, use of the InGaAs detector at 1360 nm provides further flame discrimination with an audible alarm and flash so that the user does not overlook a small flame.

The present flame imager is a low cost method of imaging hydrogen flames, alcohol flames, hydrocarbon flames, and "hot-spots" such as embers. The imager relies on human interpretations to determine the presence of a flame. An operator may discriminate between a fire and a bright light or a solar reflection because the invisible hydrogen flame, alcohol flame, or "hot spots" are only visible through the imager, while reflections and lights can be seen without the imager. The present invention can detect and image a 1 inch by 8 inch hydrogen flame at up to 75 feet.

BRIEF DESCRIPTION OF THE DRAWINGS

The following is a description of a preferred embodiment of the present invention.

DETAILED DESCRIPTION OF THE PREFERRED EMBODIMENT

Figure 1:
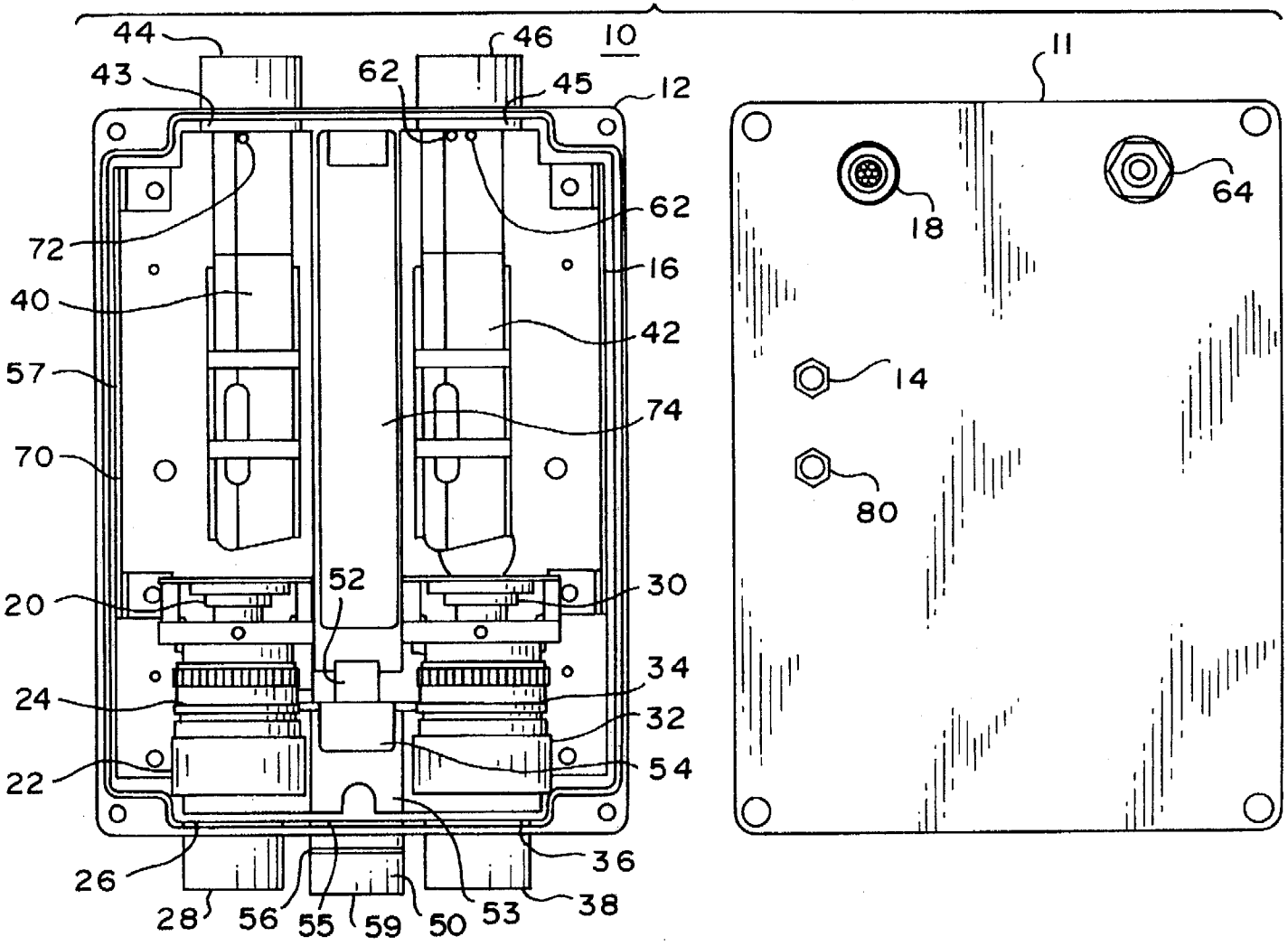
FIG. 1 is a top view of the mechanical structure of the flame imaging system 10 with the cover 11 removed.

FIG. 1 illustrates the flame imaging device 10. The imager consists of two low-light, black and white, silicon charge-coupled-device (CCD) cameras 20, 30 located within a housing 12. The CCD cameras 20, 30 have a sensitivity to light levels equal to or less than 0.05 Lux and spectral sensitivity out to 1100 nm. An example of a CCD camera is the Marshall Electronics CCD camera, part #V-1205 . The first CCD camera 20 uses a first filter 22 which during overcast conditions blocks sufficient background light so the hydrogen flame is brighter than the background light. The second CCD camera 30 uses a second filter 32, which blocks the solar background in full sunshine conditions such that the hydrogen flame is brighter than the solar background. In the preferred embodiment the first filter 22 is a 800 nm long pass filter and the second filter 32 is a 1100 nm long pass filter. Positioned between the cameras and the filters are camera lenses 24, 34. An example of a camera lens is the composite lens manufactured by Marshall Electronics, part #V-4926R. The housing 12 has an opening adjacent to each CCD filter 22, 32 with a first and second optical window 26, 36, providing a sealed window. Also, positioned in front of each optical window 26, 36 is a first and second lens tube 28, 38 attached to the housing 12. The lens tubes 28, 38 reduce the amount of glare to the CCD cameras 20, 30. In the preferred embodiment, the camera lenses 24, 34 have a limited field-of-view of ten degrees.

The two CCD cameras 20, 30 operate simultaneously so that there is no time delay in switching between the image on one camera to the other camera. A camera switch 14 located on the imager 10 allows the user to manually select a selected signal from the 800 nm filtered camera 20 or the 1100 nm filtered camera 30 to account for changing light conditions. The 800 nm filtered CCD camera 20 is used for low-light conditions such as overcast or twilight, and the 1100 nm filtered CCD camera 30 is used for bright-light conditions.

The selected signal is sent to an imaging means 40, 42. In the preferred embodiment, the imaging means are two electronic viewfinders (EVFs) 40, 42 which convert the selected signal from the camera 20, 30 into an image. These electronic viewfinders 40, 42 provide binocular viewing and a bright, clear image that is easily viewed while outdoors in full sunlight. An example of an EVF is manufactured by RCA for the CPR100 camcorder, part #XL-100.

A third and fourth optical window 43, 45 are located in the housing 12 adjacent to the EVFs 40, 42, providing a sealed, transparent opening in the housing. In the preferred embodiment, viewing tubes 44, 46 are connected to the housing 12, aligned with the EVFs 40, 42. These tubes 44, 46 reduce the amount of glare to the operator's eyes.

In addition, a video output port 18 located on the housing 12 allows a video monitor or a video recorder to be connected to the flame imager so the signal can be remotely viewed or recorded. The signal from the camera can be viewed simultaneously through the EVFs 40, 42 while being monitored and recorded remotely.

Figure 2:
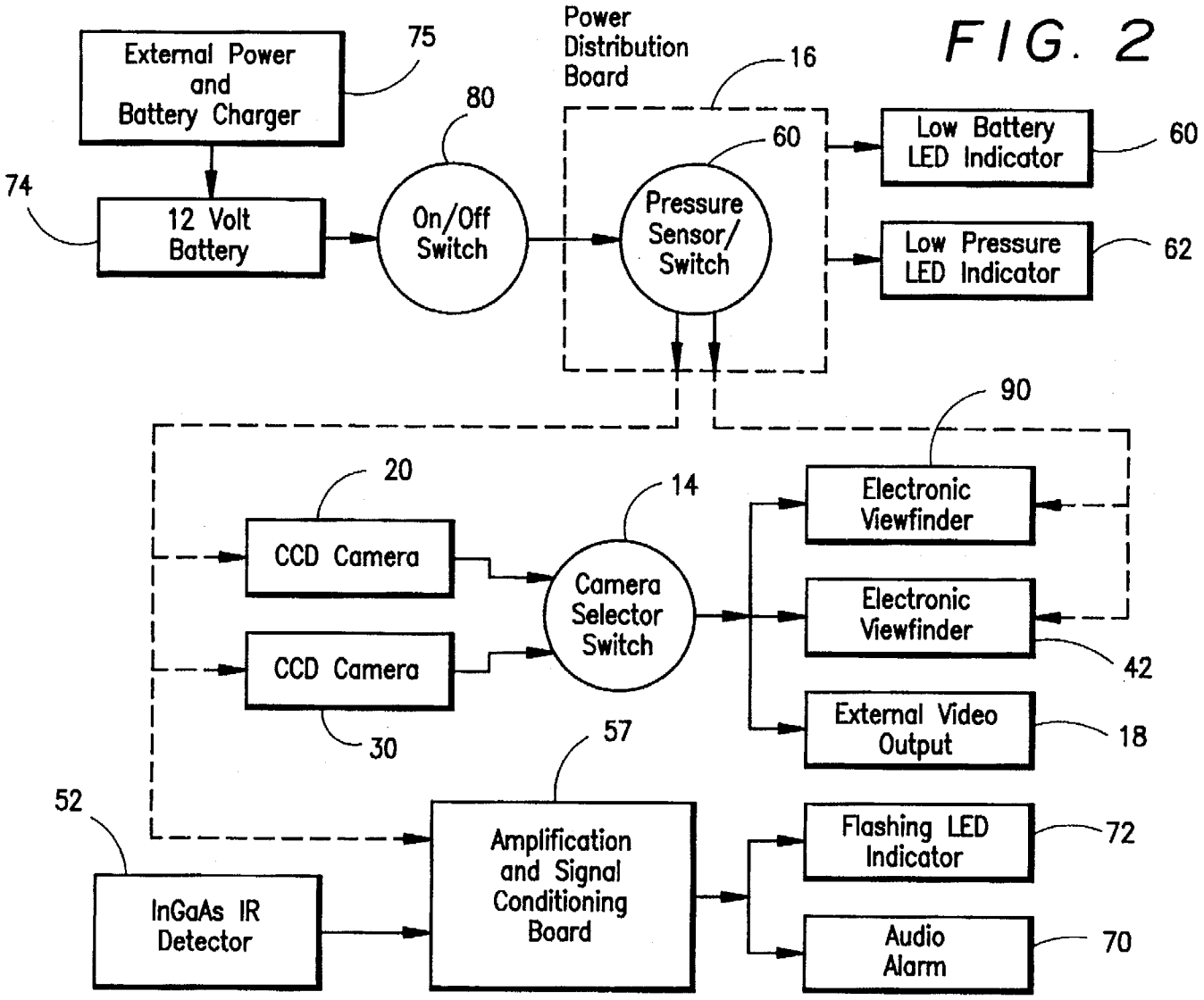
FIG. 2 is a general block diagram illustrating the circuit of the flame imaging system.

FIG. 2 illustrates the circuit of the preferred embodiment of the flame imaging system 10. A power supply 74, in particular a 12 volt Battery 74, is located within the housing 12 and provides power to the imager's components. The imager 10 also can be powered externally or charged through the video port 18 with an external power supply 75. A Power Printed Circuit Board 16 located within the housing 12 distributes power to the imager 10, including to the cameras, EVFs, LEDs, audio alarm, and pressure switch.

In the preferred embodiment of the flame imaging system 10 there is an auxiliary flame detection system 50. The auxiliary flame detection system 50 consists of a radiation responsive detector 52, specifically an Indium Gallium Arsenide (InGaAs) sensor 52, which is connected to a 1360 nm band pass filter 54. The sensor 52 is also effectively filtered at 1480 nm. A 25 mm sensor lens 56 is positioned in front of the 1360 nm filter 54 located within a third lens tube 53. However, the sensor lens 56 may also be located between the filter 54 and the sensor 52. A fifth optical window 55 is located between the sensor lens 56 and the 1360 nm filter 54 and attached to the housing 12, providing a seal for the housing 12. A fourth lens tube 59 is attached to the housing 12 adjacent to the sensor lens 56, reducing the amount of glare to the InGaAs sensor 52.

In the preferred embodiment, the rays from a flame travel through the fourth lens tube 59 to the sensor lens 56, then through the optical window 55 and the 1360 nm filter 54, to the InGaAs sensor 52. The InGaAs sensor 52 sends a signal to a signal conditioning board 57 which is connected to an alarm indicator 70, which can be either audio or visual. In the preferred embodiment the alarm indicator is an audible alarm unit 70 located on the signal conditioner 57 and a LED 72 located in an electronic viewfinder 42. The flashing of the LED 72 and the audio alarm 70 indicate the presence of a hydrogen fire, providing additional spectral discrimination of a hydrogen flame so the user does not overlook a small flame. In the preferred embodiment of this invention, the InGaAs detector 52 has a limited field-of-view (FOV) of 10 degrees so the alarm will trigger only if the flame is in the FOV of the CCD cameras 20, 30.

The housing 12 is sealed and pressurized for operation in National Electric Code (NEC) Class I, Division II, Group B hazardous environments. A pressure sensor 60 located on the Power Printed Circuit Board 16 monitors the pressure within the imager's housing 12. Also, located on the housing 12 is a pressure port 64 for pressurizing the housing 12. If the pressure within the imager 10 falls below 0.5 psi gauge, the pressure sensor/switch 60 will shut off power to the imager 10. A low pressure LED 62 located within an EVF 40, 42 turns on to indicate when there is not sufficient pressure within the imager 10.

Also, the preferred embodiment includes a hood 14 which fits over the housing 12, providing easier handling and reducing extraneous glare to the inGaAs sensor 52 and the electronic viewfinders 40, 42. An off/on switch 80 is located on the cover 11 of the housing 12 for controlling the power to the imager 10. A third LED 60 is located within an EVF 40 and turns on when the imager's power supply 74 is low. The preferred embodiment of the imager 10 is highly portable with dimensions of seven inches by five inches by three inches, and a weight of approximately five pounds.

During the operation of the present invention, an operator looks through the viewing tubes 44, 46 aiming the cameras 20, 30 in the direction of the suspect flame area. The rays from the flame and background travel through the first and second lens tubes 28, 38 through the first and second optical windows 26, 36, the filters 22, 32, and then the lenses 24, 34 to the cameras 20, 30. The cameras 20, 30 generate a first and second signal of the flame and the background scene. The operator selects with the camera switch 14 the selected signal from the first or second signal. The selected signal is sent to the EVFs 40, 42 for imaging. The EVFs 40, 42 convert the selected signal to a visible image which is sent through the third and fourth optical windows 43, 45 and the viewing tubes 44, 46 to the operator's eyes. The present invention provides an image of the flame and the background scene. While the operator is looking through the cameras, the InGaAs sensor 52 is also receiving rays within the imager's Field-of-View. The sensor 52 triggers an alarm 70 if a flame is detected, providing additional flame discrimination so the operator does not overlook a small flame.

Although the invention is disclosed in terms of a preferred embodiment, there are numerous variations and modifications that could be made thereto without departing from the invention as set forth in the following claims. For example the preferred embodiment is designed for detecting hydrogen flames but may also be used for detecting alcohol flames, hot embers, and hydrocarbon flames.

What is claimed is:

1. An apparatus for imaging an invisible flame and hot embers with a background scene comprising:

a) a housing;

b) a first camera contained in said housing for generating a first signal of the flame, the hot embers and the background scene;

c) a first filter connected to the first camera having a bandwidth for imaging the invisible flames and hot embers, and the background scene;

d) a first means for imaging the first filtered signal from the first camera and converting the first signal into a visible image; and e) a power supply connected to the camera and imaging means for supplying current thereto.

2. The apparatus of claim 1, wherein the first camera is a non-intensified silicon charge-coupled device.

3. The apparatus of claim 1, wherein the first filter transmits radiation of a wavelength above 750 nanometers.

4. The apparatus of claim 1, wherein the first filter transmits radiation of a wavelength above 1050 nanometers.

5. The apparatus of claim 1, wherein the visible image is provided to both eyes of an operator of the imager, providing binocular viewing.

6. The apparatus of claim 1, further comprising:

a) an auxiliary flame detection system.

7. The apparatus of claim 6, wherein the auxiliary flame detection system comprises:

a) a radiation responsive detector wherein the detector generates a signal in response to detected radiation;

b) a signal conditioner for analyzing the signal from the detector and determining whether a flame is present;

c) an alarm connected to the signal conditioner wherein the alarm is triggered when the flame is detected.

8. The apparatus of claim 1, further comprising:

a) a pressure port located on the housing for pressurizing the housing of the imager; and b) a pressure sensor for monitoring the pressure within the imager which shuts off the power supply when the pressure within the housing falls below a set pressure.

9. An apparatus for imaging invisible flames and hot embers with a background scene comprising:

a) a housing;

b) a first camera contained in said housing for generating a first signal of the flames and hot embers with the background scene;

c) a first filter connected to the first camera having a bandwidth for imaging the invisible flames and hot embers and the background scene during low light conditions;

d) a second camera contained in said housing for generating a second signal of the flames and hot embers with the background scene;

e) a second filter connected to the second camera having a wavelength for imaging the invisible flames, hot embers and the background scene during bright-light conditions;

f) a switch connected to the first and second camera for selecting the first or second signal as the selected signal;

g) a first means for imaging the selected signal and converting the selected signal into a visible image; and h) a power supply connected to the camera and imaging means for supplying current thereto.

10. The apparatus of claim 9, further comprising:

a) a second means for imaging the selected signal, whereby the first and second imaging means provide binocular viewing.

11. The apparatus of claim 9, wherein the cameras are charge-coupled-devices, and the first and second imaging means are electronic viewfinders.

12. The apparatus of claim 9, wherein:

a) the first filter transmits radiation of a wavelength above 750 nanometers;

b) the second filter transmits radiation of a wavelength above 1050 nanometers.

13. The apparatus of claim 12, wherein the first and second filters are longpass filters.

14. The apparatus of claim 13, wherein the camera has a spectral response with a maximum wavelength of approximately 1100 nanometers.

15. The apparatus of claim 12, wherein the camera has a spectral response with a maximum wavelength of approximately 1100 nanometers.

16. The apparatus of claim 9, further comprising:

a) an auxiliary flame detection system.

17. The apparatus of claim 16, wherein the auxiliary flame detection system comprises:

a) a radiation responsive detector wherein the detector generates a signal in response to detected radiation;

b) a signal conditioner for analyzing the signal from the detector and determining whether a flame is present;

c) an alarm connected to the signal conditioner wherein the alarm is triggered when the flame is detected.

18. The apparatus of claim 9, further comprising:

a) a pressure port located on the housing for pressurizing the housing of the imager; and b) a pressure sensor for monitoring the pressure within the imager which shuts off the power supply when the pressure within the housing falls below a set pressure.

19. An apparatus for imaging hydrogen, hydrocarbon and alcohol flames and hot embers with a background scene comprising:

a) a housing;

b) a first camera contained in said housing for generating a first signal of the flame, the hot embers and the background scene;

c) a first filter connected to the first camera having a bandwidth for imaging the invisible flames and hot embers, and the background scene;

d) a first means for imaging the first filtered signal from the first camera and converting the first signal into a visible image; and e) a power supply connected to the camera and imaging means for supplying current thereto.

* * * * *